United States Patent [19]

Lew et al.

[11] 4,431,184

[45] Feb. 14, 1984

[54] AERIAL GYMNASTIC EXERCISER

[76] Inventors: Hyok S. Lew; Yon S. Lew, both of 7890 Oak St., Arvada, Colo. 80005

[21] Appl. No.: 170,693

[22] Filed: Jul. 21, 1980

[51] Int. Cl.[3] ..... A63B 7/02; A63B 21/12

[52] U.S. Cl. ..... 272/109; 272/61; 272/118; 272/120

[58] Field of Search ..... 272/24, 61–64, 272/93, 109, 118, 120, 117, 121, 126, 128, 116, 119, 125, 134, 143; 434/255; 128/75

[56] References Cited

U.S. PATENT DOCUMENTS

| | | | |
|---|---|---|---|
| 345,856 | 7/1886 | O'Brien | 272/120 |
| 676,771 | 6/1901 | Reach | 272/118 |
| 804,218 | 11/1905 | Fiedler | 272/118 |
| 1,034,714 | 8/1912 | Kindleberger | 272/24 |
| 1,374,697 | 4/1921 | Werndli | 272/120 |
| 3,476,385 | 11/1969 | Foy | 272/24 |
| 3,937,461 | 2/1976 | Lew | 272/109 |
| 4,052,070 | 10/1977 | Lew | 272/24 X |
| 4,125,257 | 11/1978 | Lew | 272/109 |

FOREIGN PATENT DOCUMENTS

| | | | |
|---|---|---|---|
| 1018341 | 10/1957 | Fed. Rep. of Germany | 272/117 |
| 829380 | 3/1938 | France | 272/61 UX |
| 926434 | 4/1947 | France | 128/75 |
| 279927 | 4/1952 | Switzerland | 272/120 |
| 376408 | 7/1932 | United Kingdom | 272/24 |
| 222225 | 7/1968 | U.S.S.R. | 272/61 |

*Primary Examiner*—Robert A. Hafer
*Assistant Examiner*—Arnold W. Kramer

[57] ABSTRACT

The invention is an aerial gymnastic exerciser having a pair of handles depending from cords threaded through compound pulley systems located between upper and lower supports with a body harness depending from the lower support. Increase or decrease in resistance to operation of the exerciser by an operator suspended in the harness and pulling on the handles is achieved by a plurality of removable weights depending from one end of cords passing upward and over part of the pulley systems and back downward with the other ends secured to the handles. Other modifications for resistance can be by either removable weights secured to the lower support, or by removable clothespin type springs with respective ends of each removably secured to the upper and lower supports or by use of both the removable weights and springs. Resistance can also be adjusted by how much the pulley systems are compounded.

7 Claims, 2 Drawing Figures

AERIAL GYMNASTIC EXERCISER

The "Variable Tension Ring Exerciser" invented and patented by this inventor (U.S. Pat. No. 3,937,461, 4,052,070 and 4,125,257) provides an ideal means for doing gymnastic exercises for average people. However, for trained athletes capable of handling a load greater than a quarter of their body weight by each hand, the said exerciser does not provide a sufficient challenge. Also the great vertical movement of the exercising person resulting from the pulling action of the handles in the said exerciser, when the tensions in said exerciser is set reasonably high, is less than desirable in view that the insufficient vertical space available in many indoor installations of said exerciser limits the adjustability of the tension in said exerciser.

The primary object of the present invention is to provide a means to said "Variable Tension Ring Exerciser" for varying the tensions in said exerciser continuously and without bound up to one half of the body weight.

Another object of the present invention is to provide a means to said exerciser for varying the tensions in said exerciser quickly and easily.

A further object of the present invention is to provide a means to said exerciser for increasing the tensions in said exerciser without increasing the vertical movement of the exercising person resulting from the pulling action of the handles of said exerciser.

These and other objects of the present invention will become clear as the description of the present invention proceeds. The present invention may be described with a greater clarity and specificity by referring to the following Figures.

For the sake of the brevity, the "Aerial Gymnastic Exerciser" of the present invention will be referred as "Aerogym" here after.

Figure 1:
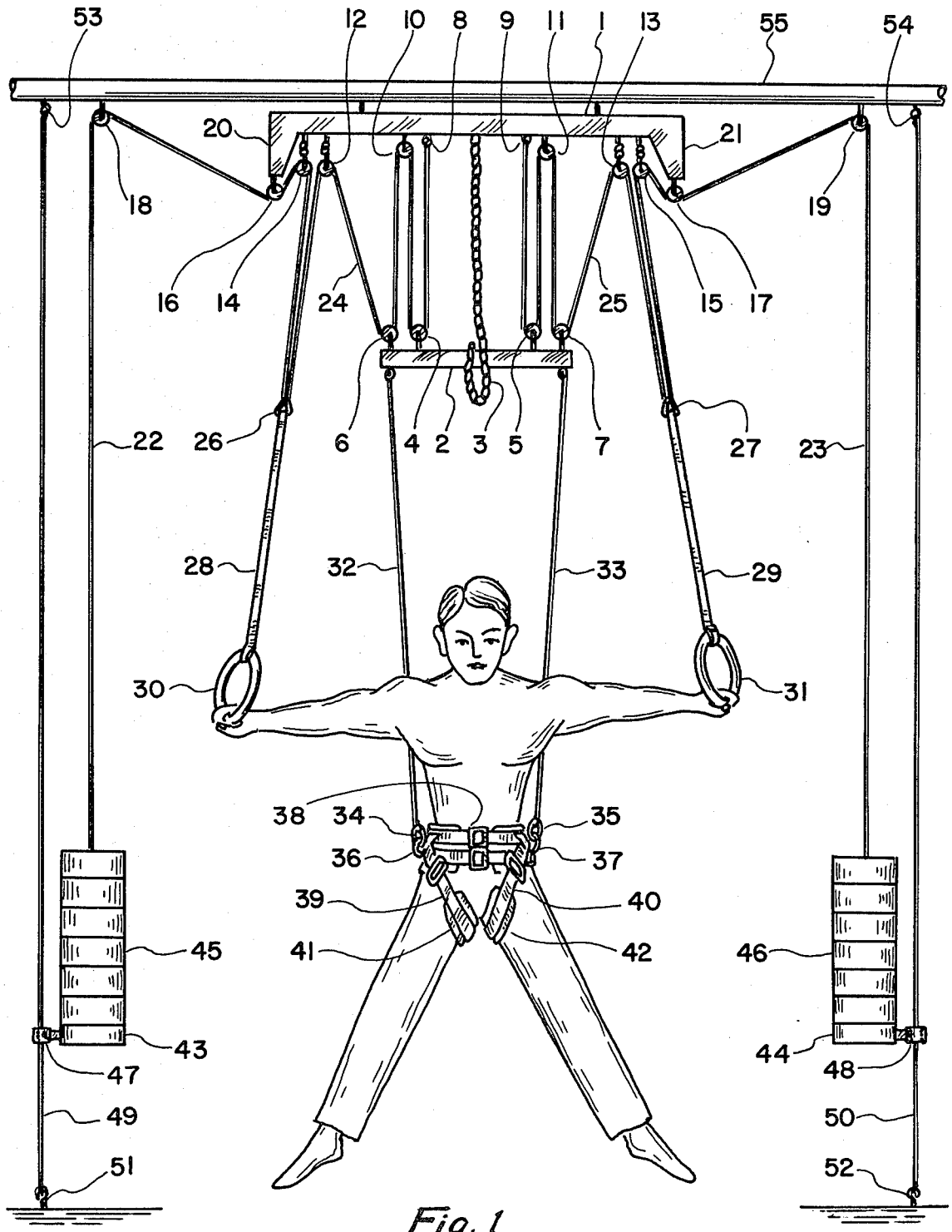
FIG. 1 illustrates an embodiment of the present invention employing a system of weights directly depending from the handles of the exerciser.

In FIG. 1 there is shown an embodiment of the present invention wherein a pair of weight systems directly depending respectively from the pair of handles are incorporated into the "Variable Tension Ring Exerciser", which is comprised of a pair of compound pulley systems, a pair of handles depending respectively from one end of each of said pair of compound pulley systems and a harness depending from the end of said pair of compound pulley systems. The compound pulley system comprises the upper bar 1 including a plurality of sheaves 10, 11 and two pair of suspended swiveling sheaves 12 and 14, and 13 and 15, respectively disposed near each extremity of upper bar 1. A pair of legs 20 and 21 respectively including sheaves 16 and 17 are further disposed at each extremity of upper bar 1, respectively. Said upper bar 1 is depending from a horizontal member 55 including a pair of sheaves 18 and 19 disposed beyond each extrimity of upper bar 1, respectively. Of course, it is obvious that the upper bar 1 can be extended to include said pair of sheaves 18 and 19. The compound pulley system further comprises lower bar 2 including a plurality of sheaves 6, 4, 5 and 7. A chain 3 links the upper bar 1 and the lower bar 2 limiting the separation of said pair of bars from one another to a distance which prevents the exercising person from hitting the ground head on when the pair of handles 30 and 31 are accidentally released. The ring handle 30 is secured to a strap 28 which is connected to a pair of cords 22 and 24 at its upper end 26. The cord 24 engages the suspended swiveling sheave 12 and simple sheaves 6, 10 and 4, and is secured to upper bar 1 by an anchoring means 8. The cord 22 engages the suspended swiveling sheave 14 and simple sheaves 16 and 18, and includes a weight support 43 carrying removable weights 45 at its lower free end. The support 43 includes a slide bearing 47 sliding over a wire 49 anchord to the floor by an eye hook 51 and to the horizontal member 55 by an eye bolt 53. The ring handle 31 is secured to a strap 29 which is connected to a pair of cords 25 and 23 at its upper end 27. The cord 25 engages the suspended swiveling sheave 13 and simple sheaves 7, 11, 5 and is anchored to the upper bar 1 by anchoring means 9. The cord 23 engages the suspended swiveling sheave 15 and simple sheaves 17 and 19 and terminates with the weight support 44 carrying the removable weights 46 at its lower free end. The weight support 44 includes a slide bearing 48 sliding over the wire 50 stretched between the floor and the horizontal member 55 by a pair of anchoring means 54 and 52. A pair of cords 32 and 33 depending from each extremity of the lower bar 2 suspend a harness. The ring 34 attached to the free end of the cord 32 removably engages a ring 36 secured to one side of the harness. The ring 35 attached to the free end of the cord 33 similarly engages the ring 37 secured to the other side of the harness. The harness comprises a pair of belts 38 with means for adjusting and securing the lengths of the front half and the rear half of said belts and a pair of straps 39 and 40 with paddings 41 and 42 securable around each thigh of the exercising person.

A person wearing said harness lifts oneself to mid-air by grabbing and pulling down the pair of handles 30 and 31 and performs a great variety of aerial gymnastics in up-right, prone, inverted and supine position which aerial gymnastic is known as the "Isometonic" exercises. The tension on the handles of the Aerogym can be easily selected to one's preference by quickly and easily removing or adding the weights 45 and 46.

Figure 2:
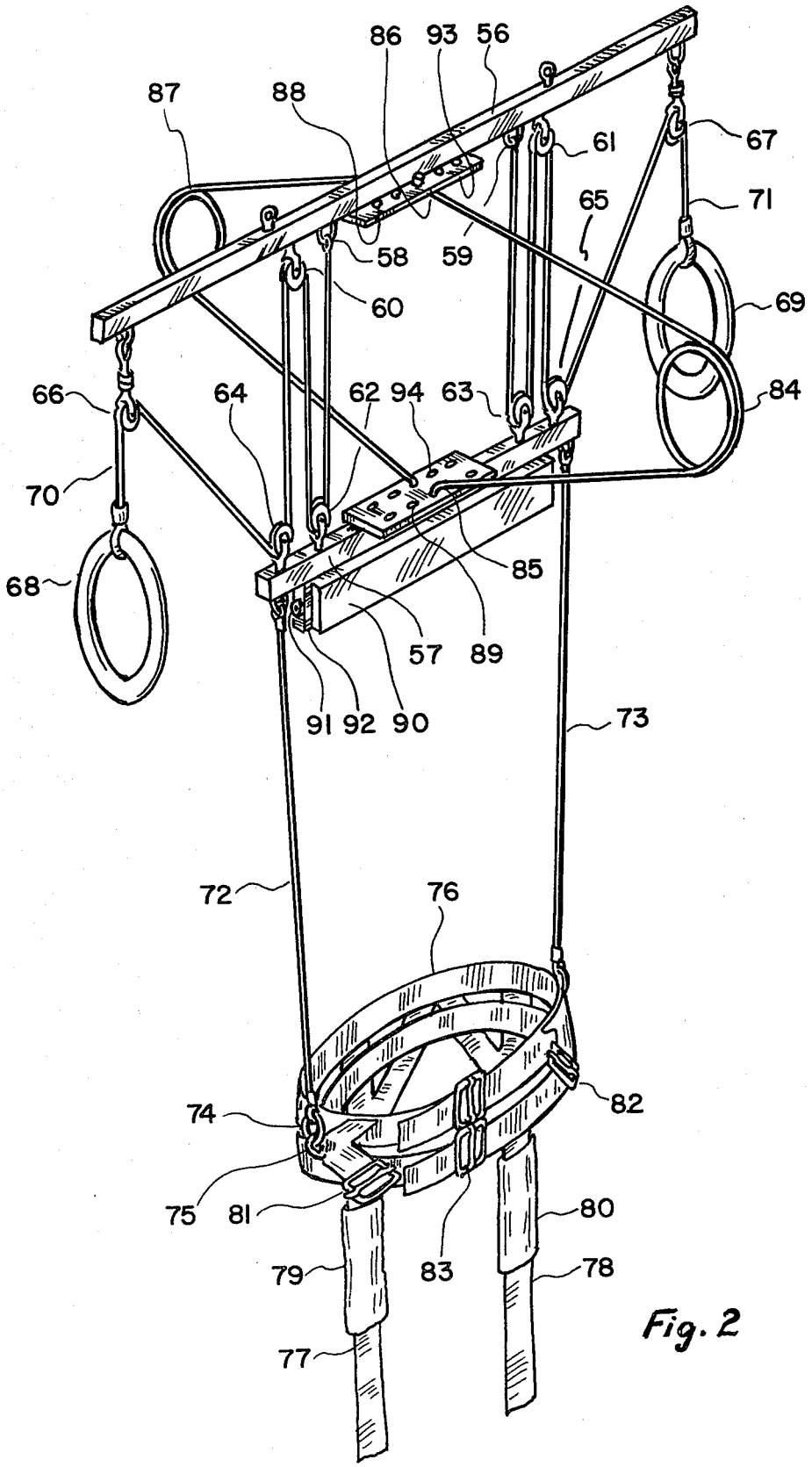
FIG. 2 shows another embodiment of the present invention employing one or more pairs of the clothespin type springs and weights incorporated into the compound pulley system as means for varying the tensions in the exerciser.

In FIG. 2, there is shown another embodiment of the present invention wherein a plurality of the clothespin type coil springs and/or weights incorporated into the compound pulley system are employed in varying the tensions in the Aerogym. The harness comprises a pair of belts 76 securable around the hip of the exercising person which belts include means 83 for adjusting and securing their lengths and a pair of straps 77 and 78 with paddings 79 and 80 which straps are securable around the thighs of the exercising person by means of a pair of adapters 81 and 82 receiving and retaining the free ends of said straps 77 and 78, respectively. The harness is suspended from the compound pulley system by a pair of cords 72 and 73 by means of the rings 74 secured to the free ends of said cords removably engaging rings 75 secured to two diametric sides of said harness. The compound pulley system comprises the upper bar 56 including a pair of suspended swiveling sheaves 66 and 67 and a plurality of simple sheaves 60 and 61, and the lower bar 57 including a plurality of simple sheaves 62, 63, 64 and 65, to which lower bar 57 the pair of cords 72 and 73 suspending the harness are secured. The cord 70 with one end 58 anchored to the upper bar 56 engages the simple sheaves 62, 60, 64 and the suspended swiveling sheave 66, and terminates with a ring handle 68. The cord 71 with one end 59 anchord to the upper bar engages a plurality of simple sheaves 63, 61 and 65 and the suspended swiveling sheave 67, and terminates with a ring handle 69. The upper bar 56 includes a plate 93 having a plurality of holes 88 receiving one angled end 86 of the clothespin type coil spring 84. The lower bar 57 includes the plate 94 having a plurality of holes 89 receiving the other angled end 85 of the clothespin type coil spring 84. In general, adding or removing said clothespin type coil springs in pairs is recommended in order to maintain the balance in the spring bias system. The weight box 90 containing a plurality of weights is attached to the lower bar 57 by means of the bolt 91 securing the weight box 90 to the leg 92 attached to the lower bar 57, which means of securing is disposed on the opposite end of said weight box also.

By using varying numbers of the clothespin type coil springs or weights contained in the weight box 90, the tension in the Aerogym can be adjusted to suite one's requirement. Of course, one may also construct an Aerogym employing the clothespin type coil springs only without the weight box or one with the weight box only without the clothespin type coil springs. For the portable unit, using the clothespin type coil springs only provides an advantage, since the clothespin type coil springs increase the tension in the Aerogym without adding a great deal of weight.

While the principles of the invention have now been made clear in an illustrative embodiment, there will be immediately obvious to those skilled in the art many modifications of structures, arrangements, proportions, the elements, materials and components used in the practice of the invention which are particularly adapted for specific environments and operating requirements without departing from those principles.

We claim:

1. An aerial gymnastic exerciser comprising in combination: a pair of overhead sheave means suspended from an overhead support; a pair of lower sheave means being connected to lower sheave support means; a harness depending from the lower sheave support means to support a gymnast; the suspension of the lower sheave support means from the overhead support including two cords, each with one end attached to either the overhead support or the lower sheave support means and threaded up and down through the respective pairs of upper and lower sheave means with the other end connected to hand grip means to be grasped by the gymnast; each of the overhead and lower sheave means comprising a plurality of pulley wheels with each of the cords threaded up and down therethrough comprising compound pulley systems; two adjustable weight means systems, each system including adjustable weights depending from one end of a cord with each cord passing upward and over at least one respective sheave mounted on the overhead support outboard of the overhead sheave means and then continuing downwardly and terminating by being secured to the hand grip means.

2. An aerial gymnastic exerciser comprising in combination: an elongated upper bar suspended from an overhead support; an elongated lower bar suspended from said upper bar; said lower bar being shorter than said upper bar; said upper bar having a plurality of sheaves on the lower side and said lower bar having a plurality of sheaves on the upper side; a harness depending from the ends of said lower bar to support a gymnast; the suspension of the lower bar from the upper bar including two cords, each with one end attached to one of the upper or lower bars and threaded up and down through the sheaves on the lower and upper bars and with the other end depending from a sheave near the outer end of the upper bar and connected to hand grip means to be grasped by the gymnast, with the two cords between the upper and lower bars over the sheaves forming compound pulley systems; two adjustable weight means systems, each system including adjustable weights depending from one end of a cord with each cord passing upward and over at least one respective sheave mounted on the overhead support outboard of the upper bar and then continuing downwardly and terminating by being secured to the hand grip means.

3. An aerial gymnastic exerciser comprising in combination: an elongated upper bar suspended from an overhead support; an elongated lower bar suspended from said upper bar; said lower bar being shorter than said upper bar; said upper bar having a plurality of sheaves on the lower side and said lower bar having a plurality of sheaves on the upper side; a harness depending from the ends of said lower bar to support a gymnast; the suspension of the lower bar from the upper bar including two cords, each with one end attached to one of the upper or lower bars and threaded up and down through the sheaves on the lower and upper bars and with the other end depending from a sheave near the outer end of the upper bar and connected to hand grip means to be grasped by the gymnast, with the two cords between the upper and lower bars over the sheaves forming compound pulley systems; and adjustable weight means including removable weights secured to the lower bar.

4. An aerial gymnastic exerciser as in claim 3 including adjustable spring bias means disposed intermediate the upper and lower bars, including removable clothespin type springs, wherein on addition or removal of weights and/or springs the resistance to operation of the exerciser can be respectively increased or decreased.

5. An aerial gymnastic exerciser comprising in combination: an elongated upper bar suspended from an overhead support; an elongated lower bar suspended from said upper bar, said lower bar being shorter than said upper bar; said upper bar having a plurality of sheaves on the lower side and said lower bar having a plurality of sheaves on the upper side; a harness depending from the ends of said lower bar to support a gymnast; the suspension of the lower bar from the upper bar including two cords, each with one end attached to one of the upper or lower bars and threaded up and down through the sheaves on the lower and upper bars and with the other end depending from a sheave near the outer end of the upper bar and connected to hand grip means to be grasped by the gymnast, with the two cords between the upper and lower bars over the sheaves comprising compound pulley systems; and adjustable spring bias means disposed intermediate the upper and lower bar, said adjustable spring bias means including a plurality of the clothes pin type coil springs with one leg secured to the upper bar and the other leg secured to the lower bar.

6. An aerial gymnastic exerciser as in claim 5 wherein the springs are removably secured to the upper and lower bars whereby, on addition or removal of springs, the resistance to operation of the exerciser is respectively increased or decreased.

7. An aerial gymnastic exerciser as in claim 6 wherein a plurality of weights are removably connected to the lower bar for additional adjustment of the resistance to operation of the exerciser.

* * * * *